US008487202B2

(12) United States Patent
Hackbarth et al.

(10) Patent No.: US 8,487,202 B2
(45) Date of Patent: Jul. 16, 2013

(54) MECHANICAL LATCHING UNIT FOR A MAIN DRIVE UNIT

(75) Inventors: Anke Hackbarth, Braunschweig (DE); Christoph Budde, Heidelberg (DE); Günther Mechler, Hassmersheim (DE); Ryan Chladny, Muskego, WI (US); Sebastian Breisch, Neckarsteinach (DE); Sven Soetebier, Ladenburg (DE); Daniel Staffas, Ludvika (SE)

(73) Assignee: ABB Technology AG, Zurich (CH)

( * ) Notice: Subject to any disclaimer, the term of this patent is extended or adjusted under 35 U.S.C. 154(b) by 81 days.

(21) Appl. No.: 13/285,409

(22) Filed: Oct. 31, 2011

(65) Prior Publication Data

US 2012/0107041 A1 May 3, 2012

Related U.S. Application Data

(63) Continuation of application No. PCT/EP2010/002125, filed on Apr. 1, 2010.

(30) Foreign Application Priority Data

Apr. 30, 2009 (EP) ..... 09005972

(51) Int. Cl.
*H01H 5/00* (2006.01)

(52) U.S. Cl.
USPC ..... 200/400; 200/318; 74/2

(58) Field of Classification Search
USPC ..... 200/318, 400
See application file for complete search history.

(56) References Cited

U.S. PATENT DOCUMENTS

| | | | | |
|---|---|---|---|---|
| 4,146,765 | A * | 3/1979 | Wilson | 200/400 |
| 7,772,513 | B2 * | 8/2010 | Ohda et al. | 200/400 |
| 7,880,105 | B2 * | 2/2011 | Hashimoto et al. | 200/400 |

FOREIGN PATENT DOCUMENTS

| | | | |
|---|---|---|---|
| DE | 4336480 | A1 | 5/1995 |
| FR | 1533998 | A | 7/1968 |
| FR | 2434472 | A2 | 3/1980 |

OTHER PUBLICATIONS

International Search Report (PCT/ISA/210) issued on Jun. 24, 2010, by European Patent Office as the International Searching Authority for International Application No. PCT/EP2010/002125.
European Search Report issued Sep. 18, 2009 for European Application No. 09005972.

* cited by examiner

*Primary Examiner* — Renee Luebke
*Assistant Examiner* — Lheiren Mae Caroc
(74) *Attorney, Agent, or Firm* — Buchanan Ingersoll & Rooney PC

(57) ABSTRACT

A mechanical latching unit for a main drive unit includes a rolling mechanical switch within a housing, with a main roller, a counter roller, a carriage and a carriage trip/locking lever, with a first joint created between the main roller and the first end of the carriage, where by the load of the traction link of the main drive unit carried out to the main roller distributes a primary force component carried out to the counter roller and a secondary force component carried out in a direction to a second end of the carriage, where by the mechanical latching unit includes a force reduction mechanism having at least two force reduction stages, a carrier reset spring fastened to the housing which resets the carriage back to a neutral respectively blocking position, and a lever reset spring which resets the carriage trip/locking lever back to a neutral respectively blocking position.

13 Claims, 4 Drawing Sheets

MECHANICAL LATCHING UNIT FOR A MAIN DRIVE UNIT

RELATED APPLICATION(S)

This application claims priority as a continuation application under 35 U.S.C. §120 to PCT/EP2010/002125, which was filed as an International Application on Apr. 1, 2010 designating the U.S., and which claims priority to European Application 09005972.6 filed in Europe on Apr. 30, 2009. The entire contents of these applications are hereby incorporated by reference in their entireties.

FIELD

The disclosure relates to a mechanical latching unit for a main drive unit.

BACKGROUND INFORMATION

A latching unit is used to lock/release a mechanical system, for example, a mechanism formed by links and joints in a defined position or operating stage. A known application of latching units can be found in electromechanical drive units for contact systems of an electric circuit breaker (for example, use in low voltage, medium voltage and high voltage applications). These latching units should have high reliability, robustness towards shock and overload conditions, large temperature ranges, high repeatability with lowest possible response time scatter, short and adjustable reaction time and total mechanical operation time.

These specifications and operating conditions can result in complex, high quality and therefore costly system design based on electromechanical subsystems. If these units are designed to have low cost there can be compromises in quality and/or performance.

FR 2 434 472 A discloses a mechanical latch mechanism for a main drive unit used in a low voltage switching device.

SUMMARY

A mechanical latching unit is disclosed for a main drive unit, for example, of an electric circuit breaker, the mechanical latching unit comprising a housing, with a main roller, a counter roller, a carriage and a carriage trip/locking lever, with a first joint created between the main roller and the first end of the carriage, where by the load of the traction link of the main drive unit carried out to the main roller distributes to a primary force component carried out to the counter roller and a secondary force component carried out in direction to a second end of the carriage, where by the mechanical latching unit contains a force reduction mechanism comprising at least two force reduction stages, a carrier reset spring fastened to the housing which resets the carriage back to a neutral respectively blocking position, and a lever reset spring which resets the carriage trip/locking lever back to a neutral respectively blocking position.

BRIEF DESCRIPTION OF THE DRAWINGS

The disclosure will now be further explained by exemplary embodiments and with reference to the accompanying drawings, in which.

DETAILED DESCRIPTION

The disclosure relates to a mechanical latching unit for a main drive unit which can provide high reliability, high repeatability with low scatter and short/adjustable reaction time and total mechanical operation time.

The mechanical latching unit according to an exemplary embodiment of the disclosure includes a main drive unit with a rolling mechanical switch within a housing, a main roller, a counter roller, a carriage and a carriage trip/locking lever. A first joint is created between the main roller and a first end of the carriage. A load of a traction link of the main drive unit carried out to the main roller distributes to a primary force component carried out to the counter roller and a secondary force component carried out in direction to a second end of the carriage. The mechanical latching unit contains a force reduction mechanism comprising at least two force reduction stages, a carrier reset spring fastened to the housing which resets the carriage back to a neutral respectively blocking position, and a lever reset spring which resets the carriage trip/locking lever back to a neutral respectively blocking position.

The mechanical latching unit for a main drive unit can satisfy challenging performance specifications based on standard parts. The use of less parts and standard parts can enable improvement in the cost to performance ratio of the latch design. A reset in a defined repeatable initial condition after one operation sequence can result. Due to the reduced number of parts, the overall reliability of the latching unit can be increased.

Figure 1:
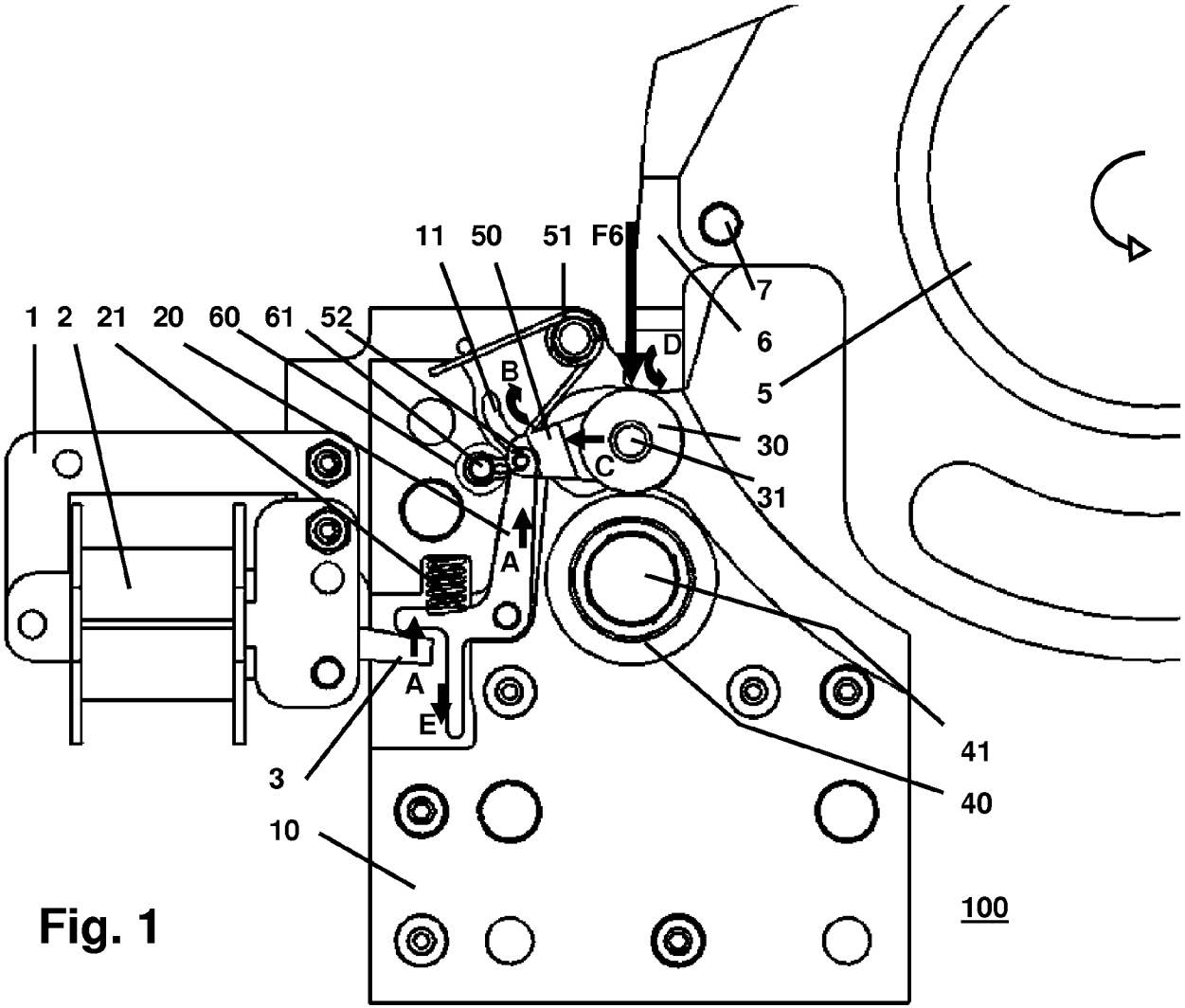
FIG. 1 shows a side view of a latching unit (sectional view) according to an exemplary embodiment of the disclosure.

FIG. 1 shows a side view of a latching unit (sectional view) according to an exemplary embodiment of the disclosure. The components of the latching unit 100 include a housing with two housing plates 10 with guiding slots 11 and end stops. A main roller 30 has a (needle) bearing and an axle 31. A counter roller 40 has a (needle) bearing and an (main) axle 41. A carriage 50, designed as a Y-bar carriage includes three mounting arms 55, 56, 57. A guide bolt (axle) 52 at a second end of the carriage 50 passes through two of these mounting arms. The guide bolt (axle) 52 engages in the guiding slots 11. A first joint is located between the main roller 30 and first end of the carriage 50. A carrier reset spring 51 is fastened to the housing to reset the carriage 50 back to a neutral or blocking position. Carriage deflection rollers 60 include (needle) bearings and axles 61. A carriage trip/locking lever 20 (actuator trip lever) has a lever reset spring 21 to reset the carriage trip/locking lever 20 back to a neutral or blocking position. A second joint is located between the second end of the carriage (50) and the carriage trip/locking lever 20. An actuator unit 1 (with electromagnetic actuation) has actuator coil 2 and swivel armature 3.

The latching unit 100 represents a "rolling mechanical switch." FIG. 1 shows a part of a main drive unit 5 (for example, a loaded torsion spring/electromechanical drive unit for a contact system of electrical circuit breaker) with a traction link 6, designed as a drive tooth which can turn round about its pivot centre 7 and contacts the main roller 30 during a locking state (neutral or blocking position). The traction link 6 pushes with a load force F6 in a direction toward the main roller 30. FIG. 1 shows the neutral or blocking position of the latching unit 100 where rotation of traction link 6 is blocked by the "rolling mechanical switch." To operate the main drive unit 5 the following exemplary steps can occur:

1) A control signal is applied to the actuator unit 1 and accordingly the swivel armature 3 moves in direction of arrow A which results in the carriage trip/locking lever 20 also moving in direction of arrow A;

2) Accordingly the guide bolt (axle) 52 of the carriage slides along the guiding slots 11 of the housing plates 10. Movement of the guide bolt (axle) 52 can be expressed by arrow B;

3) This causes a movement of the main roller 30 in a direction toward the carriage deflection rollers 60, expressed by arrow C; and 4) This movement of the main roller 30 at a substantially right angle to the force F6 deactivates an interlock. Accordingly traction link 6 rotates about its pivot centre 7 and can roll along the main roller 30, as can be expressed by arrow D.

Accordingly initial conditions are constrained through oversized slots 11 cut into the two main housing plates 10. Out of plane motion is provided through the center plate and the main roller 30, in addition to the carriage 50 and housing plates 10. Once a release operation is completed, the mechanism can be reset to its initial position by springs which will bring back the carriage 50 and the carriage trip/locking lever 20 to catch the traction link 6. That means that after cessation of the control signal to actuator unit 1, the lever reset spring 21 pushes the carriage trip/locking lever 20 back to the neutral or blocking position. See movement expressed by arrow E. After release of traction link 6, the carriage reset spring 51 pushes the carriage 50 and consequently the main roller 30 back to the neutral or blocking position. See movements opposite to the movements expressed by the arrows B and C.

After rotation, the traction link 6 returns to the main roller 30 (for example, with the help of an electrical motor of the main drive unit 5, both forwards and backwards motion can be required) and will be blocked by the main roller 30. Accordingly the latching unit 100 is prepared for the next operation sequence, for example, the following switching breaking process.

Figure 2:
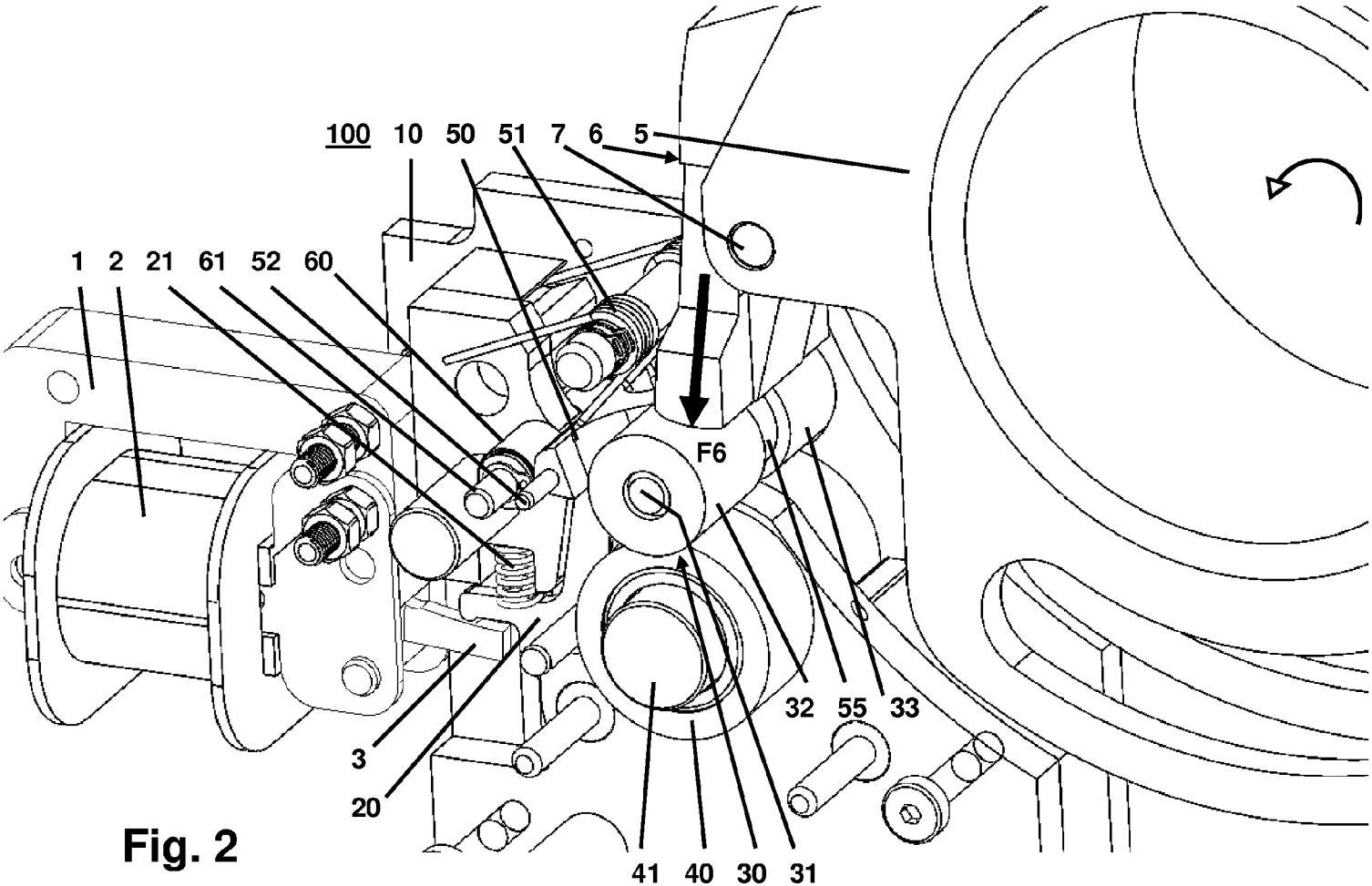
FIG. 2 shows a three-dimensional view of an opened latching unit according to an exemplary embodiment of the disclosure.

FIG. 2 shows a three-dimensional view of an opened latching unit 100 according to an exemplary embodiment of the disclosure which is mechanically connected with the main drive unit 5 (see traction link 6 with pivot centre 7) via the housing with its housing plates 10. The main roller 30 includes two separate contact rollers 32, 33 with axle 31, whereby a mounting arm 55 of the carriage 50 is fastened between these two rollers 32, 33. The axle 31 passes through a cylindrical hole 54 of this mounting arm 55. See FIGS. 6 and 7. The counter roller 41 is separated into two rollers in order to contact the two contact rollers 32, 33. During movement expressed by arrow B in FIG. 1, the mounting arms 56, 57 of the carriage 50 next to the guide bolt (axle) 52 contact the carriage deflection rollers 60. FIG. 2 shows the counter roller 40 with axle 41 contacting/supporting the main roller 30 as well as carriage trip/locking lever 20, lever reset spring 21, carriage reset spring 51 and actuator unit 1 with actuator coil 1 and swivel armature 3.

Figure 3:
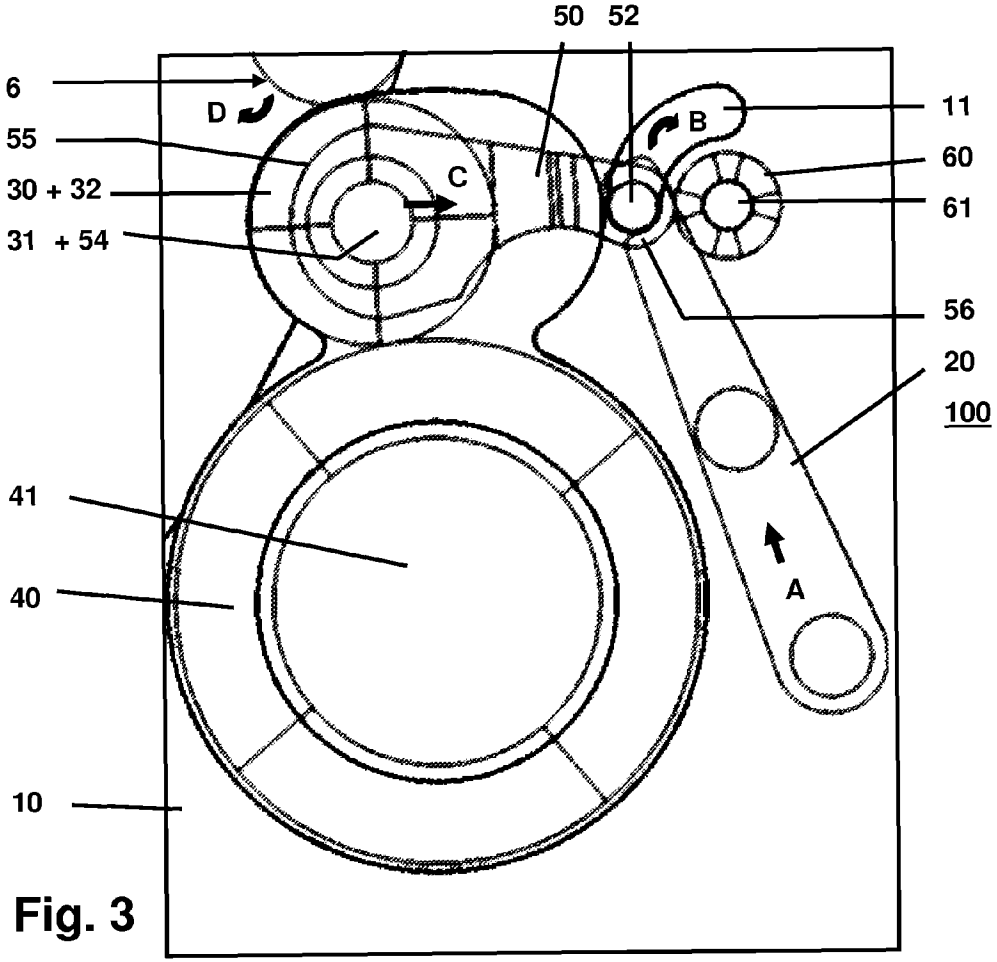
FIG. 3 shows details of the configuration according to FIG. 1.

FIG. 3 shows details of the configuration according to FIG. 1 with the main roller 30 contacting the traction link 6 via contact rollers 32, 33. Axle 31 passes through the cylindrical hole 54 of the mounting arm 55 of the carriage 50. The guiding slots 11 in the housing plates 10 of the latching unit 100 guide the guide bolt (axle) 52. The counter roller 40 includes axle 41. The carriage deflection roller 60 has axle 61. The mounting arm 56 of the carriage 50 contact roller 60.

Figure 4:
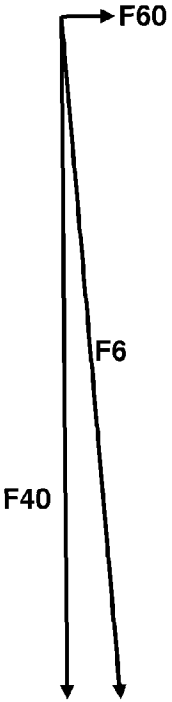
FIG. 4 shows an exemplary distribution of relevant loads and forces.

FIG. 4 shows the distribution of relevant loads and forces. The load force F6 directed to the main roller 30 by the traction link 6 is distributed as a primary force component F40 directed to the counter roller 40 and a secondary force component F60 directed toward the second end of the carriage 50, for example, toward the guide bolt 52 and to the carriage deflection roller 60. The force F6 does not exactly press in a direction toward a centre of the main roller 30 but there can be a defined (small) deviation in order to cause/support the movement of the main roller 30 and the carriage 50 in a direction toward the guide bolt 52 and the carriage deflection roller 60 after interlock deactivation.

Figure 5:
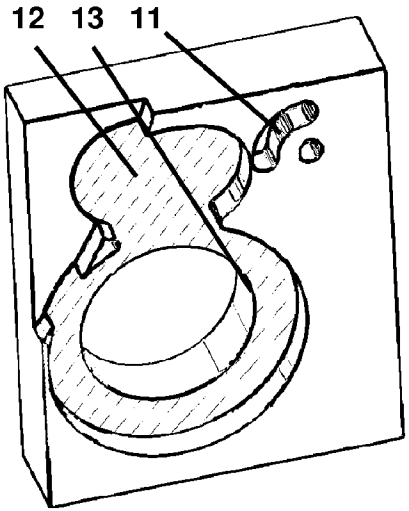
FIG. 5 shows a three-dimensional view of the inner side of a housing plate according to an exemplary embodiment of the disclosure.

FIG. 5 shows a three-dimensional view of an inner side of an exemplary embodiment of the disclosure housing plate 10. A guiding slot 11, a location space 12 for the main roller 30 and a location hole 13 for the counter roller 40 are shown. For the housing plates 10 either layered sheet metal parts, machined parts or cast parts, for example, can be used. For a housing plate 10 made of sheet metal parts, the geometry will be generated from different sheet metal layers. The parts for the left and right housing plate 10 can be the same but layered in a different order. The sheet metal layers can also allow for a scaling of the design according to the requirements of different drives in different applications for example, the higher a load the higher the number of layers or the thicker the plates for the layer.

Figure 6:
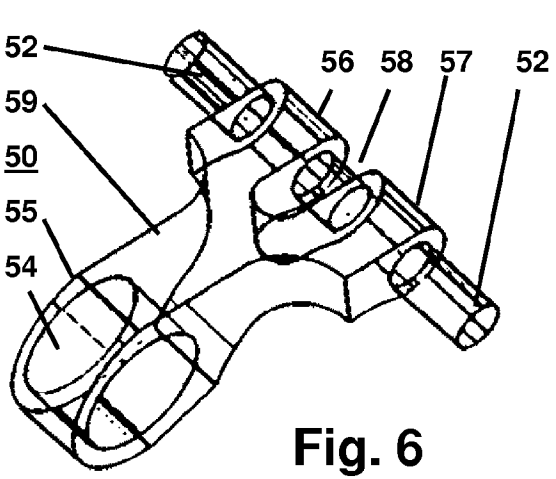
FIG. 6 shows a three-dimensional view of a carriage according to an exemplary embodiment of the disclosure.

FIG. 6 shows a three-dimensional view of a carriage. The carriage 50 includes a carriage main body 59 with a first mounting arm 55 at a first end with cylindrical hole 54 to take in the axle 31 of the main roller 30 to create the first joint. A second mounting arm 56 and a third mounting arm 57 are located at a second end to take in the guide bolt (axle) 52, where by the top end of the carriage trip/locking lever engages 20 in the slot 58 between the mounting arms 56, 57 in order to create the second joint between the carriage 50 and the carriage trip/locking lever 20 a bore at the top end.

The carriage 50 can be made, for example, as a machined part, casted part, forged part or sheet metal part or as hybrid combination. For the guide bolt (axle) 52, standard high strength parallel pins can be inserted to the carriage main body 59 at both mounting arms 56, 57.

Figure 7:
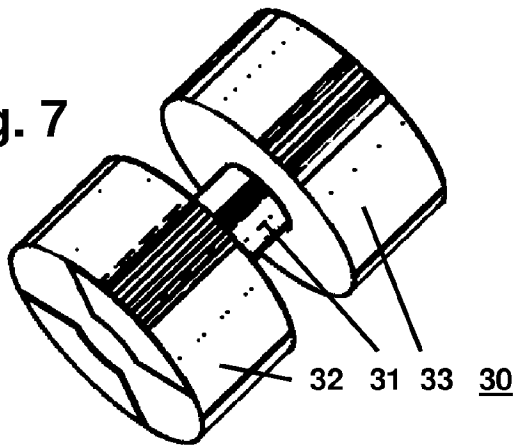
FIG. 7 shows a three-dimensional view of a main roller according to an exemplary embodiment of the disclosure.

FIG. 7 shows a three-dimensional view of a main roller 30, which can be designed as contact double roller with two separate contact rollers 32, 33 with an axle 31 between these rollers. The mounting arm 55 of the carriage 50 can engage in the space between the rollers 32, 33 in order to realize a joint between the main roller 30 and the carriage 50.

Figure 8:
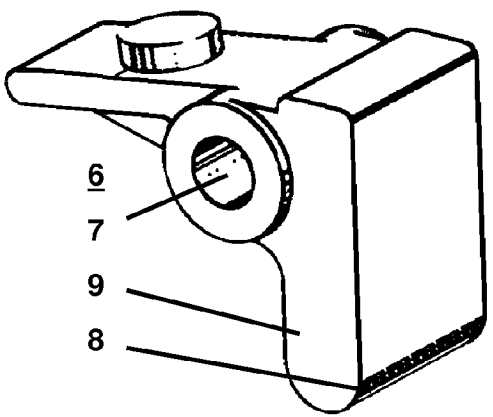
FIG. 8 shows a three-dimensional view of a traction link (drive tooth) according to an exemplary embodiment of the disclosure.

FIG. 8 shows a three-dimensional view of a traction link 6 (drive tooth), which includes two arms, arranged substantially perpendicular to each other and with a pivot centre 7 near by the connection area of both arms. A contact profile (surface) 8 of an arm 9 contacting the main roller 30 provides proper contact geometry to enable low contact stresses in the contact areas of the main roller 30 and the traction link 6 (drive tooth). In an exemplary embodiment according to the disclosure, a contact profile 8 can have a curved surface (for example, a spline or an ellipse) at least in one direction forming a line contact during its whole interaction phase with the main roller 30.

The mechanical latching unit according to exemplary embodiments of the disclosure enable to release a conversion mechanism with stored potential energy with a minimal amount of switching energy provided by the electrically operated actuator unit 1 via externally stored energy at a very short but also repeatable reaction time (meaning low scatter). A characteristic of the latching unit is a force reduction mechanism including two up to three force reduction stages (at least two stages). The described mechanism uses a set of reduction stages with a minimum number of parts. Therefore the described design can lead to a relatively small actuator unit 1 which provides high dynamic capabilities due to small inertia leading to a short overall operation time.

The main energy to drive the latch mechanism and its different stages is not provided by the actuator unit 1 (electromagnetic trip) but by the energy stored in the conversion mechanism itself which is supplied to the latch so that the latch components will be continuously accelerated. The design can be based on standard parts, for example, precision parallel pins for shafts and axles, roller bearing units defining the significant sections of the main tolerance chain. These standard components can offer a high manufacturing quality. Due to this, the latching unit 100 can provide high precision at comparably low cost. The precision can lead to high functional reliability and repeatability over a wide temperature range.

For all main supports, roller bearings can be used, cylinder roller bearing or needle bearing sets. But if the requirements towards scatter and mechanical reaction time are relaxed, friction sleeve bearings can be used which can lead to lower material cost for the latching unit 100.

The carriage trip/locking lever 20 can be realized as a sheet metal part linked to a parallel pin forming a rotary joint for the lever.

During a locking state (neutral position) the two contact rollers 32, 33 connect via the axle 31 to the carriage 50 (main lock). The shape of the carriage 50 can enable a compactness and a desirable load distribution. Each mounting arm 56, 57 of the carriage 50 contacts to a carriage deflection roller 60 which can deflect the carriage motion and enable another force reduction stage. Due to the different force reduction stages, the carriage trip/locking lever 20 and the locking/trigger actuator unit 1 can operate with a minimum energy which reduces the requirements on the system environment where the operating mechanism is installed.

Another feature of exemplary designs as disclosed herein is a minimized effort to reset the mechanism to its initial position (neutral blocking position) once an operation is completed. Only the carriage 50 needs to be brought back to its initial position, by a spring system, carriage reset spring 51. All other components, such as, for example, the rollers, do not need to be reset. They will be ready for the next operation immediately because of their rotational symmetry. This mechanical re-initialization can allow for lower scatter in the reaction and operation time which can contribute to a higher reliability of the overall breaker system.

Because the latching unit 100 uses rollers to transfer main portions of the loads, the inertia of the parts moved can be reduced compared to known latch designs. Due to the roller concept, the only link formed by carriage 50 can have a very compact design also featuring a low inertia. The kinetic energy of the rollers can be dissipated by friction, which can mean there is no need for any end stops and there will be no corresponding shocks to the design. Only the motion of the compact and light weight carriage 50 needs to be caught by the end stops in the guiding slots 11 implemented into the housing plates 10 leading to small impacts and shock compared to known designs. So the minimized inertia of the latching unit 100 will lead to low kinetic energy and small impacts contributing to reduced wear and increased system lifetime. In order to minimize contact stresses all rollers can be equipped with a convex shape.

The load force F6 (FIG. 4) through the main roller 30 is transferred primarily to the counter roller 40 with a large needle bearing and (main pin) axle 41, through force F40 shown in FIG. 4. The remaining load force F60 can be transferred to the carriage 50 through the carriage deflection roller 60 with a needle bearing joint and axle 60. The carriage 50 is in turn constrained by this carriage deflection roller 60 with secondary bearing and carriage trip/locking lever 20 actuated by the actuator unit 1.

Standard parts allow for reduced cost but high precision and high quality, scalable design, scalable performance, minimized inertia and therefore short reaction/latching time, modular approach, single or redundant actuator, self energized system. Energy is delivered from the latched system itself. Only a primary lock is actuated and powered by external power source realized by the actuator unit 1.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

1 actuator unit with electromagnetic actuation
2 actuator coil
3 swivel armature
5 main drive unit (loaded torsion spring)
6 traction link (drive tooth)
7 pivot centre
8 contact profile
9 arm
10 housing plates
11 guiding slots
12 location volume for main roller
13 location hole for counter roller
20 carriage trip/locking lever (actuator trip lever)
21 lever reset spring
30 main roller (with needle bearing)
31 axle
32 contact roller
33 contact roller
40 counter roller (with needle bearing)
41 axle
50 carriage (e.g. Y-shaped)
51 carriage reset spring
52 guide bolt (axle)
54 cylindrical hole
55 mounting arm
56 mounting arm
57 mounting arm
58 slot for carriage trip/locking lever 20
59 carriage main body
60 carriage deflection roller (with needle bearing)
61 axle
100 latching unit
A movement of swivel armature 3 and carriage trip/locking lever 20
B movement of guide bolt 52 of carriage 50 within the guiding slots 11
C movement of main roller 30

D movement of traction link 6
E movement of carriage trip/locking lever 20
F6 load, force of traction link 6
F40 force component of F6 in direction to counter roller 40
F60 force component of F6 in direction to carriage deflection roller 60

What is claimed is:

1. A mechanical latching unit for a main drive unit comprising:

a rolling mechanical switch within a housing with a main roller, a counter roller, a carriage, a carriage trip/locking lever and a first joint created between the main roller and a first end of the carriage, whereby the load of a traction link of the main drive unit carried out to the main roller distributes a primary force component carried out to the counter roller and a secondary force component carried out in a direction to a second end of the carriage, whereby the mechanical latching unit comprises:

a force reduction mechanism including at least two force reduction stages, a carrier reset spring fastened to the housing which resets the carriage back to a neutral respectively blocking position, and a lever reset spring which resets the carriage trip/locking lever back to a neutral respectively blocking position.

2. The mechanical latching unit, according to claim 1, comprising:

a second joint between the second end of the carriage and the carriage trip/locking lever.

3. The mechanical latching unit according to claim 2, wherein at least one part of the carriage is arranged for contacting at least one carriage deflection roller.

4. The mechanical latching unit according to claim 3, wherein the main roller comprises two contact rollers contacting two separate counter rollers.

5. The mechanical latching unit according to claim 4, comprising:

a swivel armature of an actuator unit for releasing the carriage trip/locking lever.

6. The mechanical latching unit according to claim 1, wherein at least one part of the carriage is arranged for contacting at least one carriage deflection roller.

7. The mechanical latching unit according to claim 1, wherein the main roller comprises two contact rollers contacting two separate counter rollers.

8. The mechanical latching unit according to claim 1, comprising:

at least one guiding slot implemented in the housing.

9. The mechanical latching unit according to claim 8, comprising:

at least one guide bolt at the second end of the carriage engages in the guiding slot and a trip force is carried out to the guide bolt in a direction to the guiding slot by the carriage trip/locking lever.

10. The mechanical latching unit, according to claim 8, comprising:

a second joint between the second end of the carriage and the carriage trip/locking lever.

11. The mechanical latching unit according to claim 10, wherein at least one part of the carriage is arranged for contacting at least one carriage deflection roller.

12. The mechanical latching unit according to claim 11, wherein the main roller comprises two contact rollers contacting two separate counter rollers.

13. The mechanical latching unit according to claim 1, comprising:

a swivel armature of an actuator unit for releasing the carriage trip/locking lever.

* * * * *